United States Patent [19]

Kiya et al.

[11] Patent Number: 4,956,678

[45] Date of Patent: Sep. 11, 1990

[54] RECORDING SHEET TRANSPORT APPARATUS

[75] Inventors: Yukitoshi Kiya, Kawasaki; Yasushi Nakazato, Tokyo, both of Japan

[73] Assignee: Ricoh Company, Ltd., Tokyo, Japan

[21] Appl. No.: 388,341

[22] Filed: Aug. 1, 1989

[30] Foreign Application Priority Data

| | | | |
|---|---|---|---|
| Aug. 18, 1988 | [JP] | Japan | 63-204999 |
| Aug. 25, 1988 | [JP] | Japan | 63-210958 |
| Dec. 20, 1988 | [JP] | Japan | 63-321658 |
| May 19, 1989 | [JP] | Japan | 1-126865 |

[51] Int. Cl.[5] ..... G03G 15/00

[52] U.S. Cl. ..... 355/318; 355/319; 271/186

[58] Field of Search ..... 355/318, 319, 309, 316, 355/321; 271/3.1, 65, 186

[56] References Cited

U.S. PATENT DOCUMENTS

| | | | |
|---|---|---|---|
| 4,693,586 | 9/1987 | Sumida et al. | 355/319 |
| 4,705,389 | 11/1987 | Maekawa et al. | 355/318 |
| 4,758,862 | 7/1988 | Fukae et al. | 355/319 |
| 4,825,245 | 4/1989 | Fukae et al. | 355/319 X |

FOREIGN PATENT DOCUMENTS 61-11864 4/1986 Japan .

*Primary Examiner*—A. C. Prescott

*Attorney, Agent, or Firm*—Cooper & Dunham

[57] ABSTRACT

A sheet transport apparatus is used in a duplex image forming apparatus which makes two-sided prints. The sheet transport apparatus has a transport path for supplying a recording sheet which is received from a paper supplying unit to an image forming part, a reversing path for reversing side of the recording sheet, and two driving sources for independently driving mechanisms which transport the recording sheet in each of the transport path and the reversing path.

15 Claims, 9 Drawing Sheets

MAIN CPU
CONTL PART 4

301
REV. START INST
REV. START
401
MOT 6 REV
402
SOLENOID 7 ON
403
REAR END ?
NO
YES
404
MOT 6 OFF
405
SOLENOID 7 OFF
406
MOT 6 FWD
407
TIP END ?
NO
YES
408
MOT 6 OFF
409
SEND MESSAGE
END
302
RECEIVE MESSAGE
303
REFEED START INST
REFEED START
501
MOT 6 FWD
502
TIP END ?
NO
YES
503
MOT 5 ON
504
TIP END GRIPPED BY ROLLERS 2E1 ?
NO
YES
505
REAR END ?
NO
YES
506
MOT 6 OFF
507
SEND MESSAGE
304
RECEIVE MESSAGE
508
REAR END
NO
YES
509
MOT 5 OFF
END

RECORDING SHEET TRANSPORT APPARATUS

BACKGROUND OF THE INVENTION

The present invention generally relates to recording sheet transport apparatuses, and more particularly to a recording sheet transport apparatus of a duplex image forming apparatus such as a duplex copying machine and a duplex printer.

As is well known, when making a copy of a document, a copied image corresponding to the document image is usually formed on one side of a single recording sheet. With the recent progress in information society, the quantity of documents, data, publications and the like is greatly increasing, but it is uneconomical to copy such documents on one side of the recording sheets. There is now an increasing demand to copy documents on both sides of the recording sheets so as to reduce the total quantity of the recording sheets.

As one method of forming images on both sides of the recording sheet, there is the following proposed duplex recording system. According to this proposed duplex recording system, a reversing path is provided within an image forming apparatus. This reversing path comprises three stages of rollers, and a gate mechanism which is provided between the rollers of the first and second stages for switching a transport path. The roller of the second stage recedes so that a recording sheet can be transported within the reversing path while reversing and transporting an immediately preceding recording sheet. Hence, it is possible to reverse the recording sheets which are successively transported.

The recording sheets which are reversed are once stacked on an intermediate tray. After the image formation with respect to one side of the recording sheets is completed, the recording sheets accommodated in the intermediate tray are successively transported so as to carry out the image formation with respect to the other side of the recording sheets. As a result, the so-called duplex recording which carries out the image formation with respect to both sides of the recording sheets is carried out at a high speed. An image forming apparatus employing such a duplex recording system for making two-sided copies is proposed for example in a Japanese Published patent application No. 61-11864.

According to the duplex recording system, the following operation is carried out by the copying machine when copying identical image information on a predetermined number of recording sheets. In this case, an image forming part successively carries out the image formation with respect to a first side of the predetermined number of recording sheets and these recording sheets are once accommodated in the intermediate tray. Then, the recording sheets having the image information recorded on the first side are supplied from the intermediate tray to the image forming part so as to successively carry out the image formation with respect to a second side of the predetermined number of recording sheets. By successively carrying out the image formation first with respect to the first side of the recording recording sheets and then with respect to the second side of the recording recording sheets, it is possible to minimize a speed reduction of the image forming part in making consecutive copies.

But on the other hand, the above described duplex recording system suffers the following problems. That is, when the duplex recording system is applied to a laser printer which is provided with an image sensor capable of storing image information and both sides of a document are to be copied, for example, it is necessary to first obtain the image information of the last page in order to copy each page of the document in a correct sequence.

For example, when copying ten pages of image information on both sides of five recording sheets #1 through #5, it is necessary to obtain the image information of pages 10, 8, 6, 4, 2, 1, 3, 5, 7 and 9 in this sequence. In this case, the pages 10, 8, 6, 4 and 2 are recorded on the first side of the recording sheets #1 through #5 and the pages 1, 3, 5, 7 and 9 are recorded on the second side of the recording sheets #5 through #1. As a result, the recording sheet #5 is recorded with the pages 1 and 2, the recording sheet #4 is recorded with the pages 3 and 4, the recording sheet #3 is recorded with the pages 5 and 6, the recording sheet #2 is recorded with the pages 7 and 8, and the recording sheet #1 is recorded with the pages 9 and 10.

The need to obtain the image information of the last page first is especially a problem when an image memory is used in an exposure scanning system of the image forming apparatus. In particular, when the quantity of the image information becomes large, the image memory must store image information amounting to a large number of pages and it is impractical from the point of view of the high cost of the image memory which can store such a large quantity of image information. Accordingly, it is possible to limit the number of recording sheets which may be accommodated in the intermediate tray for the purpose of reducing the required capacity and thus the cost of the image memory. But in this case, the speed with which consecutive copies are made becomes reduced and it contradicts the original intention to speed up the making of the consecutive copies.

On the other hand, in order to eliminate the above described problems, there is a proposed image forming apparatus which supplies the recording sheets which are accommodated in the intermediate tray to the image forming part from the bottom of the stack. When copying ten pages of image information on both sides of five recording sheets #1 through #5, it is necessary to obtain the image information of pages 2, 4, 1, 6, 3, 8, 5, 10, 7 and 9 in this sequence. In this case, the pages 2 and 4 are recorded on the first side of the recording sheets #1 and #2, the page 1 is recorded on the second side of the recording sheet #1, and the page 6 is recorded on the first side of the recording sheet #3. Then, the page 3 is recorded on the second side of the recording sheet #2, the page 8 is recorded on the first side of the recording sheet #4, and the page 5 is recorded on the second side of the recording sheet #3. Next, the page 10 is recorded on the first side of the recording sheet #5, the page 7 is recorded on the second side of the recording sheet #4, and the page 9 is recorded on the second side of the recording sheet #5. As a result, the recording sheet #1 is recorded with the pages 1 and 2, the recording sheet #2 is recorded with the pages 3 and 4, the recording sheet #3 is recorded with the pages 5 and 6, the recording sheet #4 is recorded with the pages 7 and 8, and the recording sheet #5 is recorded with the pages 9 and 10.

Therefore, the image memory need only store the pages 1 through 4 by the time the image formation of the page 1 ends, the pages 3 through 6 by the time the image formation of the page 6 ends, the pages 5 through 8 by the time the image formation of the page 8 ends, and the pages 7 through 10 by the time the image formation of the page 10 ends. As a result, the image memory only requires a memory capacity amounting to four pages, for example.

However, the following problems occur when making the two-sided copies in this manner. When making the two-sided copy, two recording sheets are not simply stacked on the intermediate tray but an operation of supplying a bottom recording sheet of the stack to the image forming part and an operation of stacking a recording sheet on the top of the stack are carried out simultaneously. For this reason, paper jams easily occur. The paper jams are caused when the recording sheet is supplied obliquely to an intended direction, two recording sheets are supplied at the same time and the like. When an attempt is made to eliminate the paper jams, the mechanism for supplying the recording sheet from the intermediate tray to the image forming part becomes complex and expensive. Furthermore, when the image forming apparatus uses recording sheets having different sizes, the intermediate tray must have a size in correspondence with a largest recording sheet which is used and the image forming apparatus itself becomes bulky.

In addition, in order to make the two-sided copy, the image forming apparatus must be provided with a driving device which drives the mechanism for reversing the recording sheet and a driving device which drives the mechanism for refeeding the recording sheet from the intermediate tray to the image forming part. As a result, the size of the image forming apparatus becomes large and the running cost thereof becomes high.

On the other hand, the recording sheet in a transport system which reverses the recording sheet and the recording sheet in the transport system which refeeds the recording sheet from the intermediate tray to the image forming part may be driven by a single driving source. In this case, the driving source selectively drives the recording sheet in one of the two transport systems, and a clutch mechanism or the like disengages the driving source from the other transport system. As a result, it is impossible to continuously transport the recording sheets in the two transport systems, and the cycle time required to make the two-sided copies may increase.

SUMMARY OF THE INVENTION

Accordingly, it is a general object of the present invention to provide a novel and useful recording sheet transport apparatus in which the problems described above are eliminated.

Another and more specific object of the present invention is to provide a recording sheet transport apparatus of a duplex image forming apparatus which has an image forming part, at least one paper supplying unit and an eject part, which recording sheet transport apparatus comprises a transport path for supplying a recording sheet which is received from the paper supplying unit to the image forming part, first transport means for transporting the recording sheet in the transport path, a reversing path for reversing side of the recording sheet, second transport means for transporting the recording sheet in the reversing path, a path selector having a first position for guiding the recording sheet from the image forming part to the reversing path and a second position for guiding the recording sheet from the image forming part to the eject part, refeeding means for refeeding the recording sheet in the reversing path to the transport path, driving means for driving the first and second transport means, and control means for controlling the path selector to one of the first and second positions and for controlling driving timings of the first and second transport means, where the driving means comprises a first driving source and a second driving source for independently driving the first and second transport means. According to the sheet transport apparatus of the present invention, it is possible to reduce the time it takes to make consecutive two-sided prints.

Still another object of the present invention is to provide the sheet transport apparatus of the above type wherein the first driving source is used in common as a driving source which is linked to the paper supplying unit for supplying the recording sheet to the transport path. According to the sheet transport apparatus of the present invention, it is possible to reduce the size of the apparatus and also reduce the running cost.

A further object of the present invention is to provide the sheet transport apparatus of the above type wherein the control means drives the first and second driving sources independently so that the first and second transport means transport the recording sheet at independent transport speeds. According to the sheet transport apparatus of the present invention, it is possible to transport the recording sheet at a high speed within the reversing path and thus effectively reduce the time it takes to make a two-sided print.

Another object of the present invention is to provide the sheet transport apparatus of the above type which further comprises detecting means for detecting the recording sheet in the reversing path and for outputting a sheet detection signal indicative of a position of the recording sheet in said reversing path, and the control means controls the driving means responsive to the sheet detection signal so that one recording sheet is refed to the transport path and another recording sheet is simultaneously supplied to the reversing path. According to the sheet transport apparatus of the present invention, it is possible to effectively reduce the time it takes to make a two-sided print.

Other objects and further features of the present invention will be apparent from the following detailed description when read in conjunction with the accompanying drawings.

DESCRIPTION OF THE PREFERRED EMBODIMENTS

Figure 1:
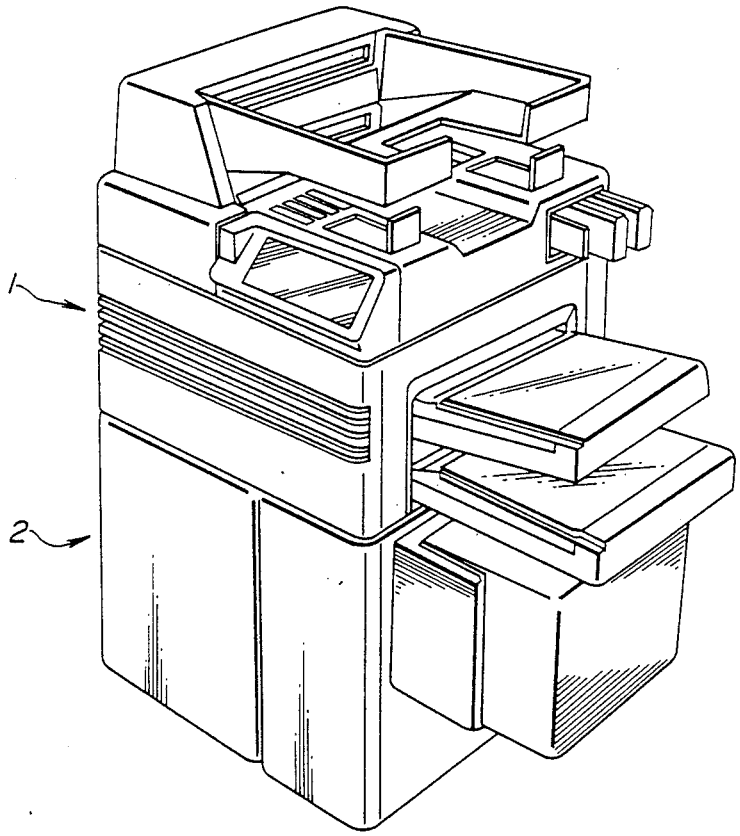
FIG. 1 is a perspective view showing an external appearance of a duplex copying machine to which a first embodiment of a recording sheet transport apparatus according to the present invention is applied.

FIG. 1 shows an external appearance of a duplex copying machine to which a first embodiment of a recording sheet transport apparatus according to the present invention is applied. The duplex copying machine is made up of a copying machine 1 which is used for a normal image formation and a duplex unit 2. The duplex unit 2 has a reversing path which communicates to an ejecting path of the copying machine 1. The duplex unit 2 reverses the side of the recording sheet and refeeds the reversed recording sheet to the copying machine 1.

Figure 2:
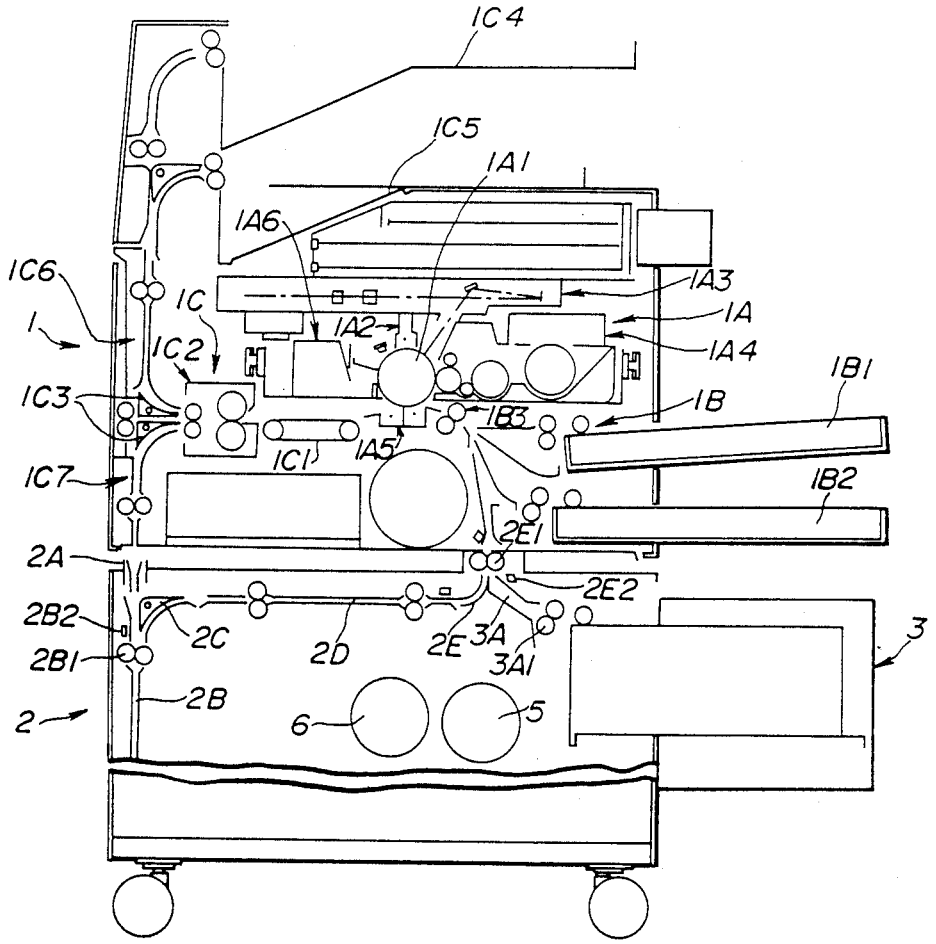
FIG. 2 is a cross sectional view showing an internal construction of the duplex copying machine shown in FIG. 1.

Unlike the conventional duplex recording system described before, the duplex unit 2 does not have an intermediate tray. The duplex unit 2 has a position where the recording sheet is held within the reversing path, and this reversing path forms a loop shaped transport path together with a recording sheet transport path within an image forming part of the copying machine 1. A number of recording sheets dependent on the lengths of the recording sheets are consecutively transported within the reversing path within the duplex unit 2. As shown in FIG. 2, the duplex unit 2 is arranged in the same housing as a paper supplying unit 3 which has a capacity for accommodating a large quantity of recording sheets.

The copying machine 1 uses a laser beam for the exposure. In other words, the copying machine 1 is a laser printer which uses the laser beam for the scanning. An image forming part 1A, a paper supplying part 1B and a paper ejecting part 1C are arranged in within the housing of the copying machine 1.

The image forming part 1A has a drum shaped photosensitive body 1A1 which is rotatable clockwise. A charging unit 1A2, an exposure scan unit 1A3, a developing unit 1A4, a transfer and separation unit 1A5 and a cleaning unit 1A6 are arranged in the periphery of the photosensitive body 1A1 along the rotating direction thereof for carrying out the image forming process.

On the other hand, the paper supplying part 1B has paper supplying cassettes 1B1 and 1B2 which are arranged in the housing of the copying machine 1 and accommodate recording sheets of different sizes. The paper supplying part 1B also has resist rollers 1B3 and transport rollers. The resist rollers 1B3 direct the recording sheet (or transfer sheet) which is supplied from the paper supplying cassette 1B1 or 1B2 to a transfer position in the image forming part 1A and transport the recording sheet in synchronism with a position of a toner image formed on the photosensitive body 1A1. The transport rollers are provided with respect to each transport path for transporting the recording sheet.

The paper ejecting part 1C has a transport belt 1C1, a fixing unit 1C2, path selectors 1C3, and paper eject trays 1C4 and 1C5. The transport belt 1C1 is arranged at a position where the recording sheet is received from the transfer and separation unit 1A5 which separates the recording sheet from the photosensitive body 1A1. For example, the fixing unit 1C2 has a combination of heating rollers and pressure rollers for fixing the image formed on the recording sheet. The path selectors 1C3 are provided at a position where the recording sheet is received after it has passed the fixing unit 1C2. The path electors 1C3 respectively have a finger which swings to select a transport path for the recording sheet. Depending on the swinging direction of the fingers of the path selectors 1C3, the recording sheet is ejected upwardly in FIG.2 to the paper eject tray 1C4 or 1C5 which are provided at the upper portion of the image forming part 1A through an ejecting path 1C6 or ejected downwardly to the duplex unit 2 through an ejecting path 1C7. A path selector selects one of the paper eject trays 1C4 and 1C5 to which the recording sheet is to be ejected through the ejecting path 1C6.

An opening 2A is formed in the duplex unit 2 at a position confronting an exit portion of the ejecting path 1C7 which is within the copying machine 1 and through which the ejected recording sheet is directed to the duplex unit 2. A reversing path 2B which connects to the opening 2A is provided inside the duplex unit 2. The reversing path 2B is arranged in a direction which coincides with the extending direction of the ejecting path 1C7 so that the reversing path 2B can switch back and reverse the recording sheet received from the copying machine 1.

The length of the reversing path 2B is set so that a recording sheet which has a maximum length can be accommodated within the reversing path 2B. A pair of reversing rollers 2B1 which can rotate in forward and reverse directions is arranged in the reversing path 2B in a vicinity of the opening 2A. In addition, a reversal sensor 2B2 for detecting the passing of the recording sheet is arranged in the reversing path 2B between the opening 2A and the reversing rollers 2B1. The reversing rollers 2B1 and the like of the duplex unit 2 will be described later in the specification.

A fork gate 2C which functions as a path selector is arranged in the reversing path 2B between the opening 2A and the reversal sensor 2B2. The fork gate 2C swings between first and second positions. In the first position indicated by a solid line in FIG. 3, the fork gate 2C permits the recording sheet which is received from the copying machine 1 to enter the reversing path 2B. On the other hand, in the second position indicated by a phantom line in FIG. 3, the fork gate 2C directs the recording sheet in the reversing path 2B to enter a refeeding path 2D which will be described later.

The refeeding path 2D extends rightwardly from the fork gate 2C in FIG.2 and is parallel to the recording sheet transport path within the copying machine I. The right end of the refeeding path 2D merges with a left end of a feedback path 2E which 15 will be described later. A plurality of pairs of rollers 2D1 are provided in the supplying path 2D at different locations to pinch and transport the recording sheet in the refeeding path 2D.

A right end of the feedback path 2E merges with a paper supplying path 3A. The paper supplying path 3A extends from the paper supplying unit 3 to an opening in the copying machine 1 for receiving the recording sheet from the feedback path 2E or the paper supplying path 3A. Rollers 2E1 are located at the position where the paths 2E and 3A merge, and these rollers 2E1 supply the recording sheet into the copying machine 1.

Figure 3:
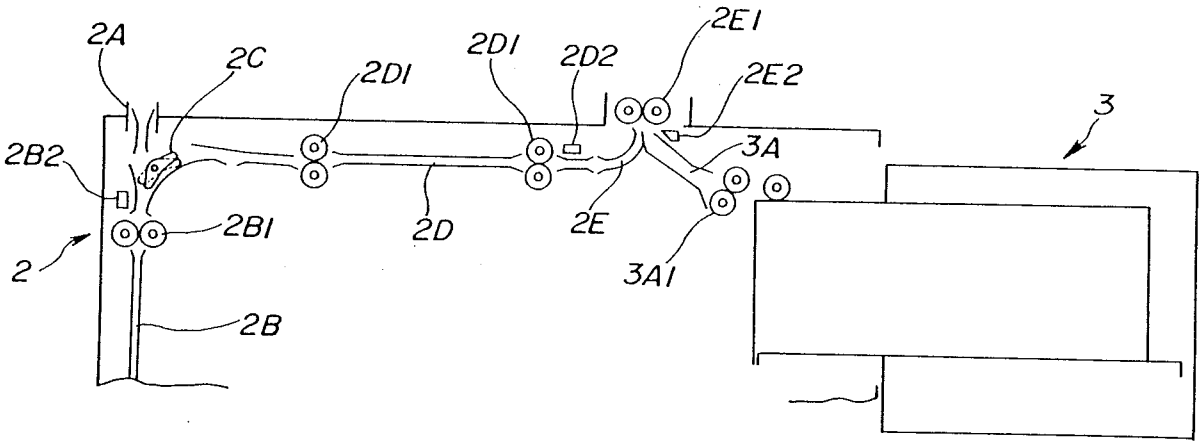
FIG. 3 is a cross sectional view showing an essential part of the first embodiment of the recording sheet transport apparatus according to the present invention.

In FIG. 3, a sensor 2D2 is provided to detect the tip end of the recording sheet in the refeeding path 2D, and a sensor 2E2 is provided to detect the tip end of the recording sheet in the feedback path 2E.

Figure 4:
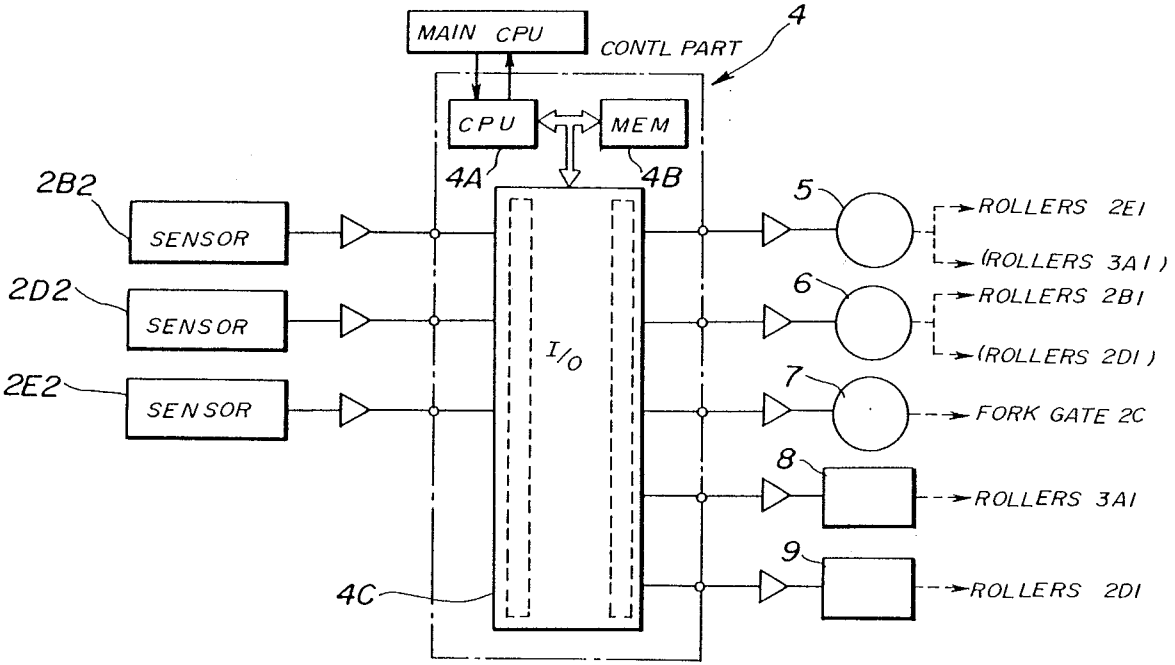
FIG. 4 is a system block diagram showing a control system of the first embodiment.

The rollers 2B1, 2D1 and 2E1 are controlled by a control part 4 shown in FIG. 4. This control part 4 is controlled by a serial communication between a main computer (shown as main CPU in FIG. 4) which constitutes a main control part of the copying machine 1. The control part 4 has a microcomputer (CPU) 4A which carries out calculations and control processes for discriminating the transport states of the recording sheets within the duplex unit 2, a memory 4B, and an input-/output (I/O) interface 4C. The memory 4B includes a read only memory (ROM) which stores basic data and basic programs which are required to control the transport of the recording sheets within the duplex unit 2, and a random access memory (RAM) which enters data from the sensors as will be described later. The input and output signals of the CPU 4A and the memory 4B are obtained via the I/O interface 4C.

The sensors 2B2, 2D2 and 2E2 are coupled to input ports of the I/O interface 4C via respective input buffers. On the other hand, motors 5 and 6, a solenoid 7, and clutches 8 and 9 are coupled to output ports of the I/O interface 4C via respective driver circuits. The motor 5 drives the transport rollers and a table elevator mechanism related to the paper supplying unit 3. The motor 6 rotates in forward and reverse directions and drives the rollers 2B1 and 2D1. The solenoid 7 switches the positions of the fork gate 2C. The solenoid 7 is excited, that is, turned ON, when switching the position of the fork gate 2C from the second position indicated by the phantom line in FIG. 3 to the first position indicated by the solid line.

Output shafts of the motors 5 and 6 are linked so as to drive the rollers in the respective paths. Out of the rollers driven by the motor 5, the rollers 2E1 are directly driven by the motor 5. In other words, the motor 5 is also used as a driving source for the rollers 2E1. Accordingly, transport rollers 3A1 for transporting the recording sheet from the paper supplying unit 3 are coupled to the motor 5 via the clutch 8 and is selectively driven by the motor 5. For this reason, while the rollers 2E1 rotate, the recording sheet is not supplied from the paper supplying unit 3.

The reversing rollers 2B1 are directly driven by the motor 6. But for example, the rollers 2D1 are linked to the motor 6 via the oneway clutch 9. This oneway clutch 9 transmits the driving torque of the motor 6 to the rollers 2D1 only when the recording sheet is directed towards the refeeding path 2D. Hence, the rollers 2D1 is driven only when the reversing rollers 2B1 rotate in the direction to transport the recording sheet to the refeeding path 2D. In this state, the motor 6 rotates in the forward direction. In FIG. 4, the clutches 8 and 9 which are respectively linked to the rollers 3A1 and 2D1 are coupled to the output ports of the I/O interface 4C because the operating timings thereof must be appropriately controlled.

The control part 4 has the following driving settings for the motors 5 and 6. That is, when successively carrying out the reversing process with respect to the recording sheets in the duplex unit 2 and supplying the reversed sheets back to the copying machine 1, the control part 4 discriminates whether or not a rear end of the leading recording sheet is ejected from the reversing path 2B when a tip end of this leading recording sheet is in position to be supplied back to the copying machine 1 from the duplex unit 2. This discrimination is made based on the state of the signal output from the reversal sensor 2B2. When it is discriminated that the rear end of the leading recording sheet is ejected from the reversing path 2B, the control part 4 supplies a trailing recording sheet from the copying machine 1 to the duplex unit 2 and at the same time supplies the leading recording sheet back to the copying machine 1.

Figure 5:
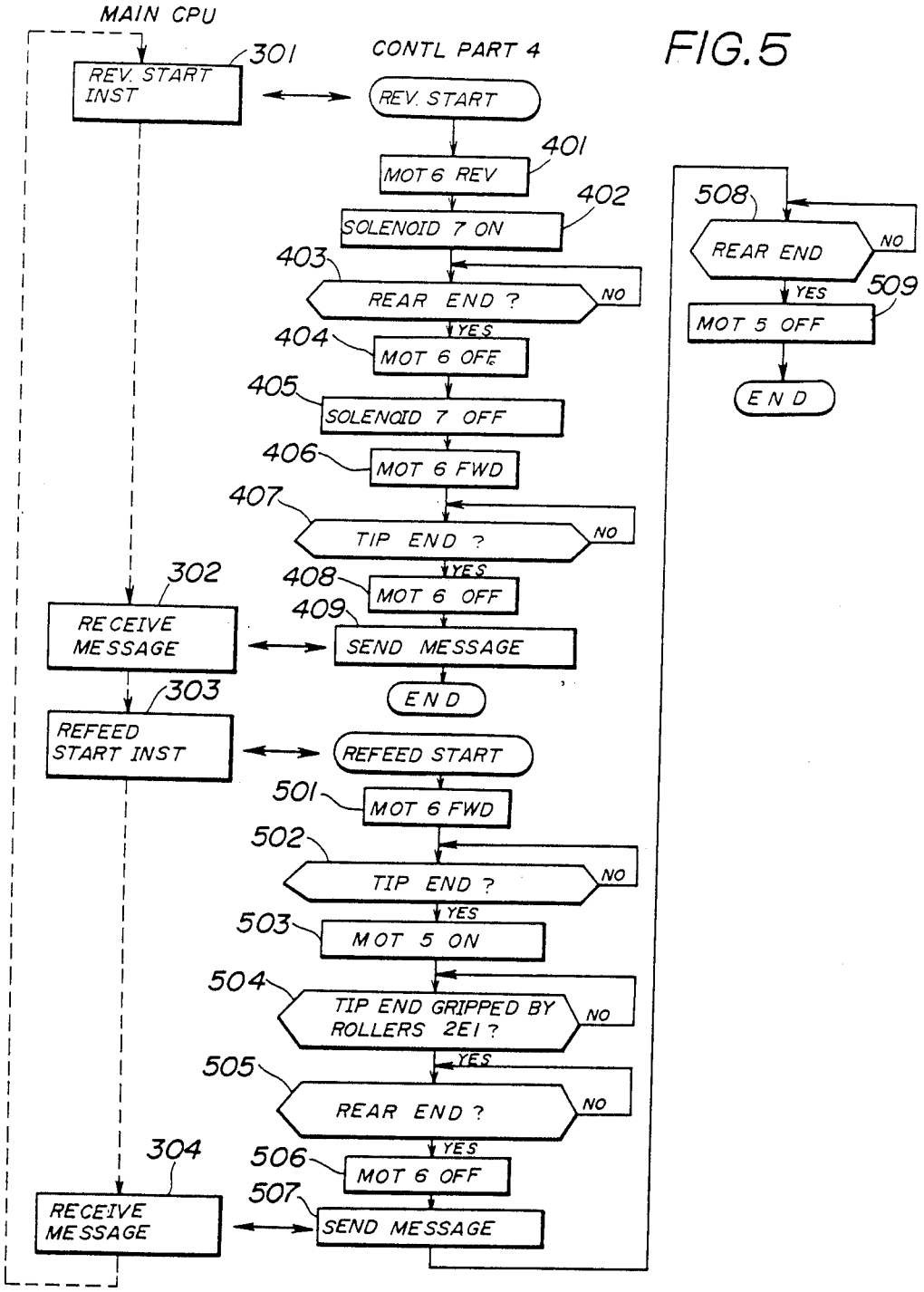
FIG. 5 is a flow chart for explaining an operation of a control part shown in FIG. 4.

FIG. 5 is a flow chart for explaining an operation of the control part 4 shown in FIG. 4. When an image is formed on one side of a recording sheet which is to be copied in a duplex print mode, the main computer of the copying machine 1 supplies a reversal start instruction to the control part 4 by a serial communication in a step 301. The control part 4 carries out the processes of steps 401 through 409 responsive to this reversal start instruction.

Figure 6A:
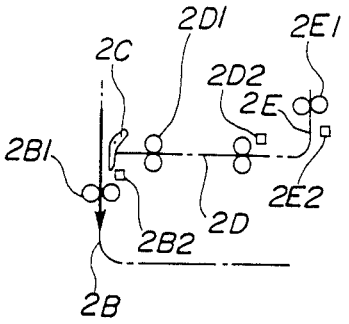
FIGS. 6A through 6G are cross sectional views respectively showing an essential part of the first embodiment for explaining an operation thereof.

The step 401 rotates the motor 6 in the reverse direction so as to transport the recording sheet towards the reversing path 2B, and the step 402 turns ON the solenoid 7 to position the fork gate 2C in the first position. Hence, as shown in FIG. 6A, the recording sheet which is ejected from the copying machine 1 is received through the ejecting path 1C7 and is supplied to the reversing path 2B. In this state, the driving force of the motor 6 is only effective with respect to the reversing rollers 2B1 because the motor 6 rotates in the reverse direction, and the clutch 9 is inactive with respect to the rollers 2D1.

Figure 6B:
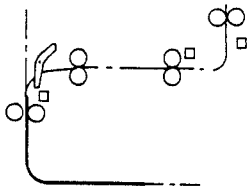

The step 403 discriminates whether or not the rear end of the recording sheet is detected by the reversal sensor 2B2. The process returns to the step 402 when the discrimination result in the step 403 is NO. Hence, the reversing rollers 2B1 are driven by the motor 6 until the rear end of the recording sheet is detected by the reversal sensor 2B2. When the discrimination result in the step 403 becomes YES, the step 404 turns OFF the motor 6 and the reversing rollers 2B1 are no longer driven by the motor 6. Because the positions of the reversal sensor 2B2 and the reversing rollers 2B1 are mutually different, the rear end of the recording sheet is pinched between the reversing rollers 2B1 as shown in FIG. 6B when the motor 6 stops and the recording sheet is held within the reversing path 2B.

Figure 6C:
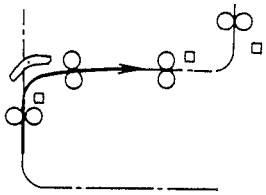

The step 405 turns OFF the solenoid 7 after a predetermined time elapses from the time when the reversal sensor 2B2 detects the rear end of the recording sheet. Thus, the fork gate 2C returns to the second position. The step 406 rotates the motor 6 in the forward direction. As a result, the recording sheet is supplied from the reversing path 2B to the refeeding path 2D as shown in FIG. 6C.

Figure 6D:
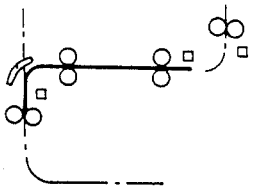

The step 407 discriminates whether or not the sensor 2D2 detects the tip end of the recording sheet in the supplying path 2D. The process returns to the step 406 when the discrimination result in the step 407 is NO. When the discrimination result in the step 407 becomes YES, the step 408 turns OFF the motor 6 so that the recording sheet is held within the refeeding path 2D as shown in FIG. 6D. The step 409 sends to the main computer a message indicating that the preparations for refeeding the recording sheet through the feedback path 2E is completed, and waits in this state until a refeed start instruction is received from the main computer.

The main computer receives the message from the control part 4 in a step 302, and sends the refeed start instruction in a step 303. The control part 4 carries out the processes of steps 501 through 509 responsive to this refeed start instruction.

The step 501 rotates the motor 6 in the forward direction so that the recording sheet can be refed to the copying machine 1. The step 502 discriminates whether or not the tip end of the recording sheet is detected by the sensor 2E2. The process returns to the step 501 when the discrimination result in the step 502 is NO, and the rotation of the motor 6 in the forward direction is maintained until the tip end of the recording sheet is detected by the sensor 2E2.

Figure 6E:
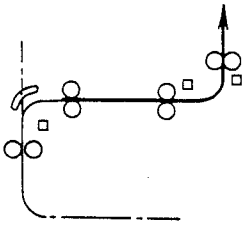
Figure 6F:
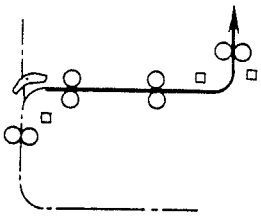

When the discrimination result in the step 502 becomes YES, the step 503 turns ON the motor 5. The step 504 discriminates whether or not the tip end of the recording sheet is gripped by the rollers 2E1, that is, whether or not the recording sheet can be refed by the rollers 2E1, by detecting the tip end of the recording sheet by the sensor 2E2. When the discrimination result in the step 504 becomes YES, a process is carried out to permit a subsequent recording sheet to enter the reversing path 2B. This process is carried out to refeed the leading recording sheet and simultaneously enter the trailing recording sheet in the reversing path 2B when the rear end of the leading recording sheet is completely ejected from the reversing path 2B. The step 505 discriminates whether or not the rear end of the leading recording sheet is detected by the reversal sensor 2B2 after a predetermined time elapses from the time when the sensor 2E2 detects the tip end of the leading recording sheet. When the discrimination result in the step 505 becomes YES, it is discriminated that the rear end of the leading recording sheet is located at a position shown in FIG. 6E or 6F. Hence, when the trailing recording sheet is ejected from the copying machine 1 by the time the rear end of the leading recording sheet reaches the position shown in FIG. 6E or 6F, the refeeding of the leading recording sheet to the copying machine 1 and the supply of the trailing recording sheet to the duplex unit 2 are carried out simultaneously.

Accordingly, when it is detected that the rear end of the leading recording sheet is detected by the reversal sensor 2B2 after the predetermined time elapses from the time when the sensor 2E2 detects the tip end of the leading recording sheet, the step 506 turns OFF the motor 6 and the step 507 sends to the main computer a message indicating that the preparations for reversing the trailing recording sheet is completed, that is, the duplex unit 2 is ready to receive the trailing recording sheet into the reversing path 2B.

The main computer receives the message from the control part 4 in a step 304. When the main computer thereafter sends the reversal start instruction, the steps 401 through 409 are carried out responsive thereto with respect to the trailing recording sheet. But at the same time, the steps 508 and 509 are carried out with respect to the leading recording sheet.

Figure 6G:
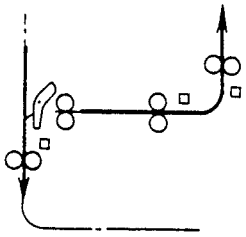

The step 508 discriminates whether or not the rear end of the leading recording sheet is detected by the sensor 2E2. When the discrimination result in the step 508 becomes YES, the step 509 turns OFF the motor 5. Hence, the rollers 2E1 are rotated by the motor 5 until the rear end of the leading recording sheet is detected by the sensor 2E2. FIG. 6G shows the state where the refeeding operation with respect to the leading recording sheet and the reversing operation with respect to the trailing recording sheet are carried out simultaneously.

This embodiment does not use an intermediate tray for stacking the recording sheets which are to be refed to the image forming part. Hence, there is no need to provide separation rollers for separating each recording sheet from the stack and no mechanism is required to raise and lower the intermediate tray. As a result, the construction of the recording sheet transport apparatus is relatively simple. In addition, there is no need to receive the image data of the last page first when successively making the two-sided copied on a plurality of recording sheets. For example, when the transport paths in the copying machine 1 and the duplex unit 2 form a loop and two recording sheets are constantly transported in the loop, it is only necessary to obtain the image information of pages 2, 4, 1, 6, 3, 8, 5, 10, 7 and 9 in this sequence when copying ten pages of image information on both sides of five recording sheets #1 through #5. Hence, the image memory only requires a memory capacity amounting to four pages, for example.

Next, a description will be given of a second embodiment of the recording sheet transport apparatus according to the present invention. In this embodiment, the recording sheet which is subjected to the image formation on one side thereof is reversed in a transport path immediately before being refed to the image forming path.

Figure 7:
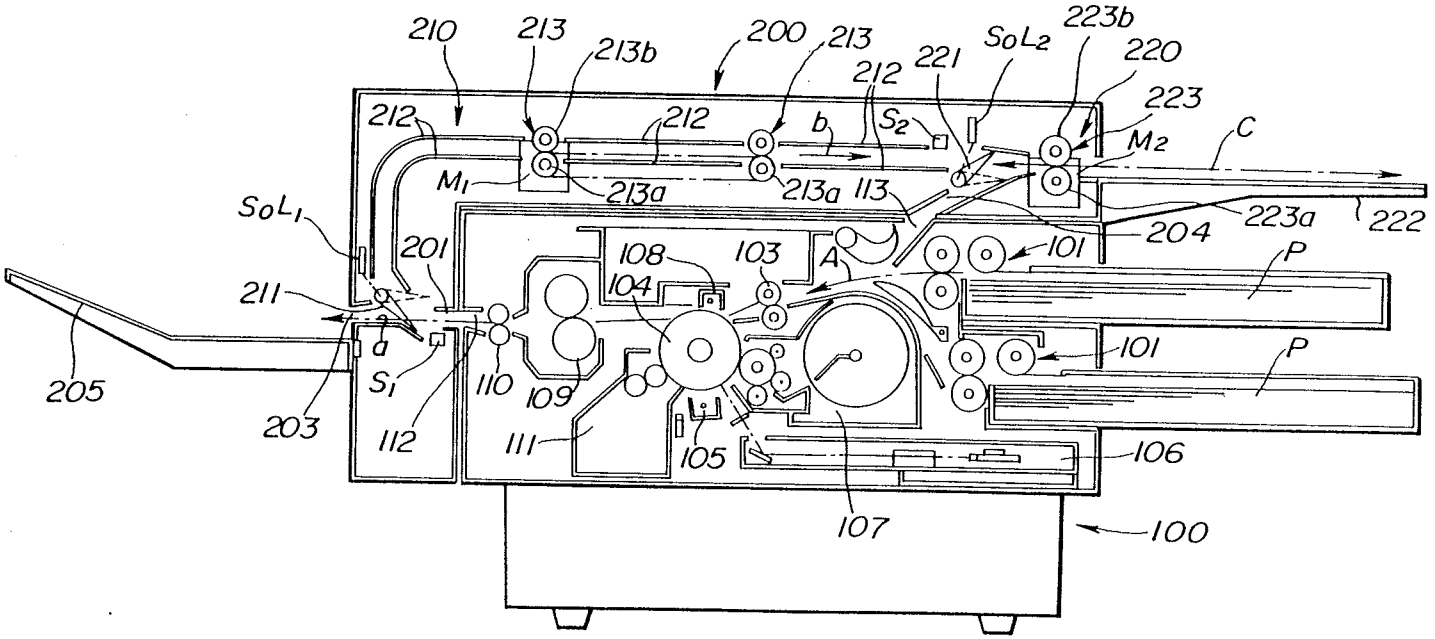
FIG. 7 is a cross sectional view showing a duplex copying machine to which a second embodiment of the recording sheet transport apparatus according to the present invention is applied.

FIG. 7 shows a duplex copying machine to which the second embodiment of the recording sheet transport apparatus according to the present invention is applied. In FIG. 7, the duplex copying machine having the above described transport path is made up of a laser printer 100 and a duplex unit 200.

The laser printer 100 generally comprises a paper supplying unit 101, a pair of resist rollers 103, a drum shaped photosensitive body 104, a charger 105, a laser optical system 106, a developing unit 107, a transfer charger 108, a fixing unit 109, eject rollers 110 and a cleaning unit 111.

A recording sheet P which is fed in a direction A from the paper supplying unit 101 is transported towards the photosensitive body 104 with a predetermined timing by the resist rollers 103. The photosensitive body 104 is rotated counterclockwise, and the surface of the photosensitive body 104 is charged by the charger 105. An electrostatic image is formed on the surface of the photosensitive body body 104 by a laser beam which is irradiated on the surface from the laser optical system 106. The electrostatic image is visualized into a toner image by the developing unit 107. This toner image is transferred onto one side (front surface) of the recording sheet P which is transported towards the photosensitive body 104. The toner image on the recording sheet P is thereafter fixed by the fixing unit 109.

The recording sheet P having the fixed image on one side thereof is ejected by the eject rollers 110. The recording sheet P is ejected outside the main body of the laser printer 100 through an ejecting opening 112. On the other hand, the cleaning unit 111 cleans the surface of the photosensitive body 104 and removes the residual toner. The above described operation is repeated to print images on the subsequent recording sheets.

The duplex unit 200 comprises a transport means 210 and a reversing means 220. The transport means 210 includes an entrance sensor $S_1$, a path selector 211, transport guides 212, transport rollers 213 and the like.

Figure 8:
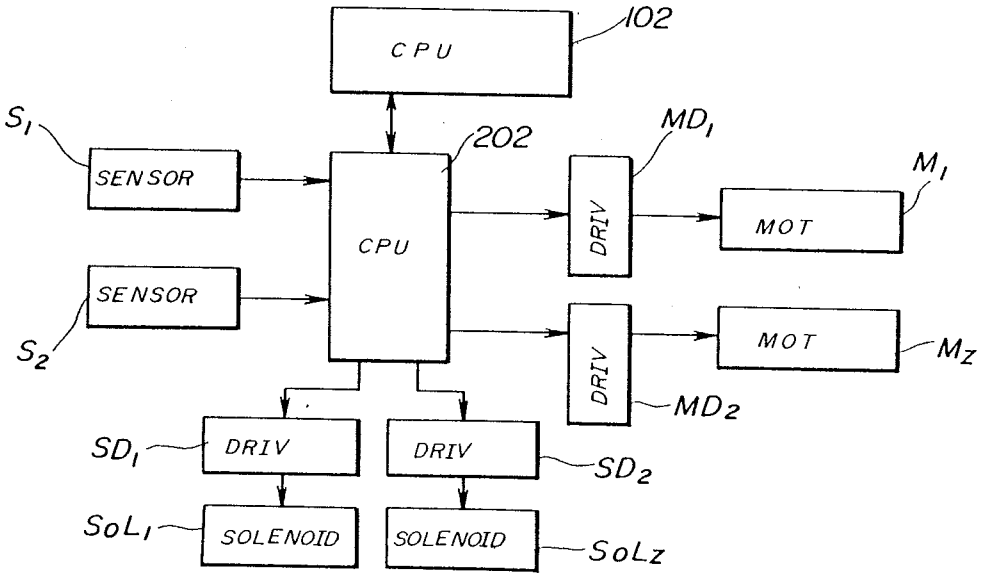
FIG. 8 a system block diagram showing a control system of the second embodiment.

The entrance sensor $S_1$ is arranged at a sheet receiving opening 201 of the duplex unit 200 confronting the ejecting opening 112 of the laser printer 100. The entrance sensor $S_1$ detects the recording sheet P which is ejected through the ejecting opening 112 and outputs a sheet detection signal. The output sheet detection signal of the entrance sensor $S_1$ is supplied to a central processing unit (CPU) 202 of the duplex unit 200. The CPU 202 is shown in FIG. 8 and will be described later.

The path selector 211 has first and second positions with respect to a sheet ejection path a which connects the sheet receiving opening 201 of the duplex unit 200 and the sheet ejecting opening 112 of the laser printer 100. The path selector 211 intercepts the sheet ejection path a in the first position indicated by a solid line in FIG. 7 and recedes from the sheet ejection path a in the second position indicated by a phantom line. The position of the path selector 211 is determined by OFF/ON state of a solenoid $Sol_1$ which is coupled to an output port of a CPU 202 via a solenoid driver $SD_1$ as shown in FIG. 8. FIG. 8 shows a control system of the second embodiment.

The transport guides 212 are designed to guide the recording sheet P which is received through the sheet receiving opening 201 towards the paper supplying part. In this embodiment, the transport guides 212 guide the recording sheet P towards a paper supplying opening 113 which is located at the top portion of the main body of the laser printer 100.

The transport rollers 213 a plurality of drive rollers 213*a* and rollers 213*b* which confront the corresponding drive rollers 213*a* about a transport path b which is formed by the transport guides 212. The drive rollers 213*a* are driven by a transport motor $M_1$ which is a stepping motor. The transport motor $M_1$ is coupled to an output port of the CPU 202 via a motor driver $MD_1$ as shown in FIG. 8.

On the other hand, the reversing means 220 comprises a reversal sensor $S_2$, a path selector 221, a switchback tray 222, switchback rollers 223 and the like.

The reversal sensor $S_2$ is arranged at a junction between a reversing path c which communicates to an opening 204 of the duplex unit 200 and the transport path b of the transport means 210. The opening 204 confronts the paper supplying opening 113 of the laser printer 100. The reversal sensor $S_2$ detects the recording sheet P which is transported from the transport path b to the reversing path c and outputs a sheet detection signal. The output sheet detection signal of the entrance sensor $S_2$ is supplied to the CPU 202 of the duplex unit 200.

The path selector 221 has first and second positions depending on ON/OFF states of a solenoid $SoL_2$. The path selector 221 is in the first position indicated by a solid line when transporting the recording sheet P towards the paper supplying opening 113 of the laser printer 100. The path selector 221 is in the second position indicated by a phantom line when transporting the recording sheet P towards the switchback tray 222 of the duplex unit 200. The solenoid $SoL_2$ is coupled to an output port of the CPU 202 via a solenoid driver $SD_2$.

The switchback tray 222 temporarily holds the recording sheet P which is transported through the transport path b. The switchback tray 222 is provided on a side of the duplex unit 200.

The switchback rollers 223 are constituted by a drive roller 223*a* and a corresponding roller 223*b* which confront each other about the reversing path c. The drive roller 223*a* is driven and rotated in a forward direction by a motor $M_2$ which is a stepping motor. The motor $M_2$ is coupled to the CPU 202 via a motor driver $MD_2$.

The CPU 202 of the duplex unit 200 makes a serial communication with a CPU 102 of the laser printer 100 through an interface. The duplex unit 200 receives instructions such as a number of copies to be made, print start and print stop instructions and the like.

The duplex unit 200 operates as follows. As is well known, the duplex unit 200 functions only when the duplex copying machine is in the duplex print mode for making two-sided copies. The duplex unit 200 does not function when the duplex copying machine is in a normal print mode for making one-sided copies. In other words, in the normal print mode, the solenoid $SoL_1$ is OFF and the path selector 211 is in the second position indicated by the phantom line in FIG. 7. Accordingly, after the image is formed on one side of the recording sheet P in the normal print mode, the recording sheet P is ejected through the ejecting opening 112 of the laser printer 100 and passes through the transport path a to be ejected onto an eject tray 205 through a sheet eject opening 203. The eject tray 205 is provided on a side of the duplex unit 200.

Figure 9:
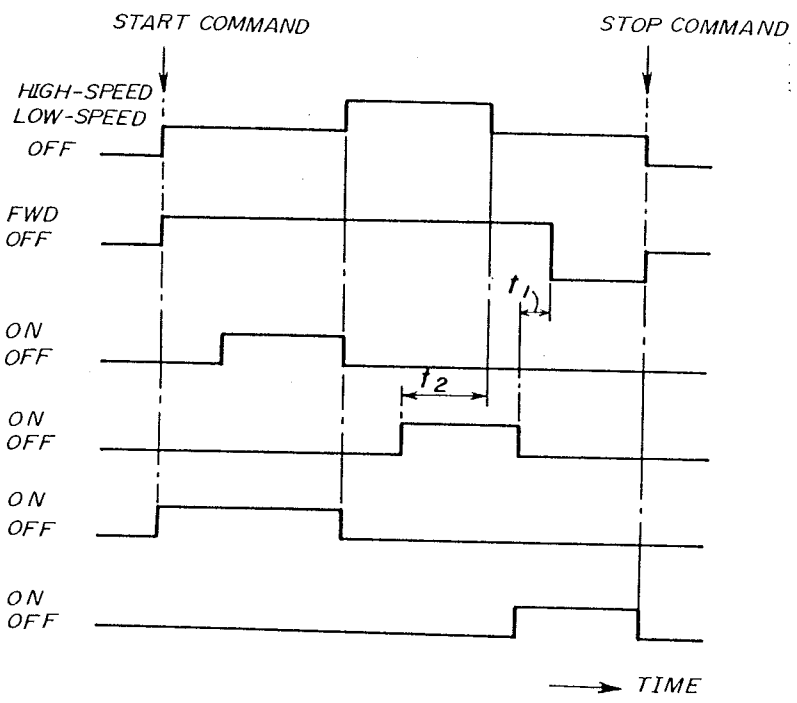
FIGS. 9(A) through 9(F) are timing charts for explaining an operation of the control system of the second embodiment.

In the duplex print mode, a start instruction is supplied to the CPU 102 and the image is formed on one side of the recording sheet P. Then, when a start command is supplied to the CPU 202 from the CPU 102 as shown in FIGS. 9(A) through 9(F) at a predetermined time prior to the ejection of the recording sheet P from the laser printer 100, the solenoid $SoL_1$ is turned ON via the solenoid driver $SD_1$ as shown in FIG. 9(E). FIGS. 9(A) through 9(F) respectively show states of the motors $M_1$ and $M_2$, the sensors $S_1$ and $S_2$, and the solenoids $SoL_1$ and $SoL_2$. When the solenoid $SoL_1$ turns ON, the path selector 211 switches to the first position indicated by the solid line in FIG. 7, the motors $M_1$ and $M_2$ are rotated in the forward direction via the respective motor drivers $MD_1$ and $MD_2$, and the rollers 213 and 223 are rotated in the forward direction.

After the image is formed on one side of the recording sheet P, this recording sheet P is ejected through the ejecting opening 112 of the laser printer 100 and is transported along the transport path b by the transport means 210 which comprises the path selector 211, the transport guides 212 and the transport rollers 213. In this state, when the rear end of the recording sheet P which is ejected from the laser printer 100 is detected by the entrance sensor $S_1$, an instruction is output from the CPU 202 to switch the driving frequency of the motor driver $MD_1$ and the motor $M_1$ is rotated at a high speed.

In this state, the solenoid $SoL_1$ is turned OFF and the path selector 211 returns to the second position indicated by the phantom line in FIG. 7. Hence, the recording sheet P is transported at the high speed in the transport path b. The rotational speed of the motor $M_1$ is returned to the initial rotational speed after a predetermined time t2 elapses from the time when the tip end of the recording sheet P is detected by the reversal sensor $S_2$. Next, when the rear end of this recording sheet P is detected by the reversal sensor $S_2$, the solenoid $SoL_2$ is turned ON via the solenoid driver $SD_2$ and the path selector 221 is switched to the first position indicated by the solid line in FIG. 7. When a predetermined time t1 elapses from the time when the reversal sensor S detects the rear end of the recording sheet P, an instruction is output from the CPU 202 to control the motor driver $MD_2$ and rotate the motor $M_2$ in the reverse direction. Accordingly, the switchback rollers 223 are rotated in the reverse direction and the recording sheet P is switched back towards the transport path b.

In this state, the path selector 221 is in the first position indicated by the solid line in FIG. 7. Thus, the recording sheet P is refed from the opening 204 of the duplex unit 200 to the transport path of the laser printer 100 through the paper supplying opening 113 of the laser printer 100. Hence, the recording sheet P is supplied towards the photosensitive body 104 with a predetermined timing so that the other side (back surface) of the recording sheet P confronts the surface of the photosensitive body 104. An image is formed on this other side of the recording sheet P, and the two-sided copy is completed. A stop command is supplied to the CPU 202 and the motors $M_1$ and $M_2$ and the solenoids $SoL_1$ and $SoL_2$ are turned OFF.

When successively making a plurality of two-sided copies, an image is formed on one side of a leading recording sheet P and an image is formed on one side of a trailing recording sheet P while the leading recording sheet P is transported towards the switchback tray 222. Further, a start command is output from the CPU 102 when the trailing recording sheet P reaches a predetermined position, and an image is formed on the other side of the leading recording sheet P while the trailing recording sheet P is transported towards the switchback tray 222.

The transport speeds of the leading and trailing recording sheets P are set so that the leading and trailing recording sheets P are constantly separated by a predetermined distance, and the timings with which the transport means 210 and the reversing means 220 are driven are appropriately to maintain the predetermined distance or interval.

On the other hand, the recording sheet P which is formed with the images on both sides thereof is ejected onto the eject tray 205, similarly as in the case of the normal print mode.

In this embodiment, the transport means 210 which transports the recording sheet P and the reversing means 220 which reverses the recording sheet P are independently driven by the respective motors $M_1$ and $M_2$ at independent timings. For this reason, there is no need for the trailing recording sheet P to wait while the leading recording sheet P is reversed, and the recording sheets P can be transported consecutively into the transport path b.

The sheet transport apparatus of the present invention is of course not limited to the application to duplex copying machines, and may be applied to various kinds of duplex image forming apparatuses including a duplex printer.

Further, the present invention is not limited to these embodiments, but various variations and modifications may be made without departing from the scope of the present invention.

What is claimed is:

1. A recording sheet transport apparatus of a duplex image forming apparatus which has an image forming part, at least one paper supplying unit and an eject part, said recording sheet transport apparatus comprising:

a transport path for supplying a recording sheet which is received from the paper supplying unit to the image forming part;

first transport means for transporting the recording sheet in said transport path;

a reversing path for reversing side of the recording sheet;

second transport means for transporting the recording sheet in said reversing path;

a first path selector having a first position for guiding the recording sheet from the image forming part to said reversing path and a second position for guiding the recording sheet from the image forming part to the eject part;

refeeding means for refeeding the recording sheet in said reversing path to said transport path;

driving means for driving said first and second transport means; and control means for controlling said first path selector to one of said first and second positions and for controlling driving timings of said first and second transport means, said driving means comprising a first driving source and a second driving source for independently driving said first and second transport means.

2. The recording sheet transport apparatus as claimed in claim 1 wherein said transport path is provided above said reversing path.

3. The recording sheet transport apparatus as claimed in claim 1 wherein said transport path is provided below said reversing path.

4. The recording sheet transport apparatus as claimed in claim 1 wherein said control means controls said driving means so that at least a total of two recording sheets are transported within said transport path and said reversing path when said duplex image forming apparatus consecutively makes two-sided prints having images formed on both sides of the recording sheet.

5. The sheet transport apparatus as claimed in claim 1 wherein said first driving source is used in common as a driving source which is linked to the paper supplying unit for supplying the recording sheet to said transport path.

6. The sheet transport apparatus as claimed in claim 1 wherein said control means drives said first and second driving sources independently so that said first and second transport means transport the recording sheet at independent transport speeds.

7. The sheet transport apparatus as claimed in claim 1 which further comprises detecting means for detecting the recording sheet in said reversing path and for outputting a sheet detection signal indicative of a position of the recording sheet in said reversing path, said control means controlling said driving means responsive to the sheet detection signal so that one recording sheet is refed to said transport path and another recording sheet is simultaneously supplied to said reversing path.

8. The sheet transport apparatus as claimed in claim 1 which further comprises a switchback tray for holding the recording sheet which is received through said reversing path, a second path selector having a first position for guiding the recording sheet from the reversing path to said transport path via said refeeding means and a second position for guiding the recording sheet from said reversing path to said switchback tray, said second path selector being controlled to one of the first and second positions by said control means.

9. The sheet transport apparatus as claimed in claim 8 wherein said transport path is provided below said reversing path.

10. The recording sheet transport apparatus as claimed in claim 8 wherein said control means controls said driving means so that at least a total of two recording sheets are transported within said transport path and said reversing path when said duplex image forming apparatus consecutively makes two-sided prints having images formed on both sides of the recording sheet.

11. The sheet transport apparatus as claimed in claim 8 wherein said control means drives said first and second driving sources independently so that said first and second transport means transport the recording sheet at independent transport speeds.

12. The sheet transport apparatus as claimed in claim 8 which further comprises detecting means for detecting the recording sheet in said reversing path and for outputting a sheet detection signal indicative of a position of the recording sheet in said reversing path, said control means controlling said driving means responsive to the sheet detection signal so that one recording sheet is refed to said transport path and another recording sheet is simultaneously supplied to said reversing path.

13. The sheet transport apparatus as claimed in claim 8 which further comprises detecting means for detecting the recording sheet in said reversing path and for outputting a sheet detection signal indicative of a position of the recording sheet in said reversing path, said control means controlling said second path selector responsive to the sheet detection signal to control said second path selector to one of the first and second positions.

14. The sheet transport apparatus as claimed in claim 1 wherein at least one paper supplying unit is provided adjacent to said transport path.

15. The sheet transport apparatus as claimed in claim 14 wherein at least another paper supplying unit is provided adjacent to said reversing path.

* * * * *